US012740601B1

(12) United States Patent
Cheung

(10) Patent No.: US 12,740,601 B1
(45) Date of Patent: Sep. 22, 2026

(54) DETACHABLE CLOTHING ASSEMBLY, GARMENT AND CLOTHING CONNECTION METHOD

(71) Applicant: Chi Ho Cheung, Kowloon (HK)

(72) Inventor: Chi Ho Cheung, Kowloon (HK)

( * ) Notice: Subject to any disclaimer, the term of this patent is extended or adjusted under 35 U.S.C. 154(b) by 0 days.

(21) Appl. No.: 19/217,066

(22) Filed: May 23, 2025

(30) Foreign Application Priority Data

Apr. 24, 2025 (CN) ..... 202510525186.0

(51) Int. Cl.

| | |
|---|---|
| ***A41B 3/00*** | (2006.01) |
| ***A41B 3/04*** | (2006.01) |
| ***A41B 7/04*** | (2006.01) |
| ***A41F 1/00*** | (2006.01) |

(52) U.S. Cl.
CPC ..... *A41B 3/04* (2013.01); *A41B 7/04* (2013.01); *A41F 1/002* (2013.01)

(58) Field of Classification Search
CPC ..... A41B 3/04; A41B 7/04; A41F 1/002
See application file for complete search history.

(56) References Cited

U.S. PATENT DOCUMENTS 1,631,856 A * 6/1927 Dray ..... A41B 3/04 2/127
2,033,651 A * 3/1936 Roseman ..... A44B 17/0058 112/406
2,116,685 A * 5/1938 Virginia ..... A45D 44/08 2/60
2,182,486 A * 12/1939 Broder ..... A41B 3/04 2/139
2,266,910 A * 12/1941 Rosenfeld ..... A41B 3/04 2/139
2,319,875 A * 5/1943 Michel ..... A41D 27/18 2/139
2,451,364 A * 10/1948 Spector ..... A41B 3/14 2/139
2,500,985 A * 3/1950 Goetz ..... A41B 3/02 2/127

(Continued)

*Primary Examiner* — Richale L Quinn
(74) *Attorney, Agent, or Firm* — Budzyn IP Law, LLC

(57) ABSTRACT

The present application pertains to the clothing field, disclosing a detachable clothing assembly, garment and clothing connection method. The subject invention includes two magnetic coupling portions, on a mounting component, which are displaceable to form a first gap. An insertion portion of an accessory, configured to match the first gap, is inserted therein. When the magnetic coupling portions are magnetically engaged, the insertion portion becomes securely retained, enabling rapid connection between the accessory and mounting component. Disassembly is achieved by separating the magnetic coupling portions to release the insertion portion. This assembly provides simplified operation for quick installation/removal, where magnetic engagement between the attraction members enhances structural integrity, effectively preventing disengagement of the accessory under external forces, thereby improving connection reliability in clothing applications. The configuration allows consumers to independently interchange collars and cuffs, reducing material waste, promoting environmental sustainability, while adding customizable features and aesthetic versatility to garments.

12 Claims, 15 Drawing Sheets

(56) References Cited

U.S. PATENT DOCUMENTS 2,646,570 A * 7/1953 Rinehart ..... A41B 1/10 2/116
2,655,661 A * 10/1953 Persin ..... A41B 3/04 2/140
2,740,967 A * 4/1956 Parets ..... A41B 3/04 2/139
2,934,768 A * 5/1960 Williams ..... A41B 3/04 D2/847
2,997,718 A * 8/1961 Jacobs ..... A41D 27/18 2/139
3,860,967 A * 1/1975 Tedesco ..... A41B 3/00 2/139
4,249,267 A * 2/1981 Voss ..... A41F 1/002 2/121
D290,545 S * 6/1987 Montalvo ..... D2/602
5,572,773 A * 11/1996 Bauer ..... A41F 1/002 24/303
5,722,126 A * 3/1998 Reiter ..... A41F 1/002 24/303
5,956,769 A * 9/1999 Stepney ..... A41B 1/00 2/129
6,009,601 A * 1/2000 Kaufman ..... H01F 7/0263 24/49.1
6,105,166 A * 8/2000 Thomas, III ..... A41D 27/16 2/60
6,477,749 B1 * 11/2002 Reiter ..... A41F 1/002 24/66.1
7,086,092 B1 * 8/2006 Cruz ..... A41F 1/002 2/132
7,770,236 B2 * 8/2010 Gulisano ..... A41B 3/04 2/127
9,332,788 B2 * 5/2016 Jelveh ..... A43B 3/08
11,432,606 B1 * 9/2022 Reiter ..... A44B 17/0041
11,606,983 B2 * 3/2023 Hastings ..... A41B 3/04
12,096,804 B2 * 9/2024 Reid ..... A41B 3/18
2005/0108805 A1 * 5/2005 Shade ..... A41B 3/04 2/129
2007/0033702 A1 * 2/2007 Hsu ..... A41B 3/04 2/129
2012/0260397 A1 * 10/2012 Reda ..... F21V 17/105 2/102
2014/0041093 A1 * 2/2014 Korobkin ..... A41D 27/16 2/60
2015/0047105 A1 * 2/2015 Fonzo ..... A41F 1/002 2/265
2016/0135508 A1 * 5/2016 Lawrence ..... A41B 3/18 2/129
2016/0206028 A1 * 7/2016 Marks ..... A41F 1/002
2016/0302489 A1 * 10/2016 Grayson ..... A41B 7/04
2017/0006974 A1 * 1/2017 Zur ..... A44B 17/0047
2018/0213851 A1 * 8/2018 O'Donnell ..... A41B 3/02
2019/0059451 A1 * 2/2019 Hastings ..... A41F 1/00
2019/0069620 A1 * 3/2019 Davis ..... A43B 1/0054
2019/0110527 A1 * 4/2019 Ghasletwala ..... A41F 1/002
2019/0183187 A1 * 6/2019 Reiter ..... A44B 17/0064
2019/0328068 A1 * 10/2019 Reiter ..... A44B 17/0041
2021/0298399 A1 * 9/2021 Mckee ..... A41F 1/002
2022/0386709 A1 * 12/2022 Onwumbiko ..... A41B 3/18
2025/0302131 A1 * 10/2025 Harris ..... A41F 1/002

* cited by examiner

DETACHABLE CLOTHING ASSEMBLY, GARMENT AND CLOTHING CONNECTION METHOD

TECHNICAL FIELD

The present application pertains to the field of clothing technology, and specifically relates to a detachable clothing assembly, an article of clothing, and a clothing connection method.

BACKGROUND

In daily use, collars and cuffs are particularly susceptible to perspiration-induced yellowing and abrasion. Given their conspicuous positioning and the fact that these components are either stitched or integrally molded with the garment's main body, consumers are compelled to discard the entire garment even when its principal portion remains serviceable. This unnecessary waste has driven the development of detachable collar and cuff designs that can be separated from the main body of the clothing.

In conventional technologies, detachable designs for garments primarily employ button and zipper mechanisms. These conventional fastening systems present operational complexities: buttons require multiple aligned fastening points necessitating sequential engagement, while zippers demand precise alignment for closure and are prone to jamming or inconsistent sliding performance. These limitations s result in cumbersome clothing assembly/disassembly processes with low operational efficiency. Furthermore, such conventional fasteners exhibit limited connection strength and tensile resistance, rendering them susceptible to failure. There accordingly exists a pressing need for a garment detachment structure that enables rapid disengagement while maintaining robust connection integrity, thereby satisfying consumer demands for expedited collar and cuff replacement functionality. This innovation would concurrently achieve waste reduction, environmental protection, and enhanced garment modularity.

SUMMARY

To address, at least partially, the aforementioned technical deficiencies, the present disclosure provides a detachable clothing assembly including:

a mounting component, configured to be connected to a main body of the clothing, the mounting component including two magnetic coupling portions arranged oppositely, where the two magnetic coupling portions can move away from each other to form a first gap between the two magnetic coupling portions, and can attract each other to close the first gap; and an accessory, including a main body of the accessory and an insertion portion arranged at an end of the main body of the accessory, where the insertion portion is matched with the first gap to be inserted into the first gap, and is limited by the magnetic coupling portion when the two magnetic coupling portions attract each other.

In an optional embodiment, the insertion portion includes:

an extension section, connected to the main body of the accessory; and a limiting protrusion, provided at an end of the extension section, where the limiting protrusion cooperates with the magnetic coupling portion to limit a position of the accessory.

In an optional embodiment, a limiting groove is provided on a surface of the magnetic coupling portion, and the limiting protrusion is snapped into the limiting groove to achieve limiting the position.

In an optional embodiment, a length of the extension section in a depth direction of the first gap is greater than or equal to a depth of the first gap, and the limiting protrusion extends from one side of the magnetic coupling portion to the other side of the magnetic coupling portion and is limited by a side portion of the magnetic coupling portion.

In an optional embodiment, the mounting component further includes:

an accommodating portion, connected to the magnetic coupling portion and forming a limiting cavity at a side of the magnetic coupling portion adjacent to the main body of the clothing, where the limiting protrusion is received in the limiting cavity upon insertion.

Optionally, the accommodating portion includes a connecting fabric, the magnetic coupling portion includes a flexible magnetic strip sewn to one side of or inside within the connecting fabric, and the limiting cavity includes a space enclosed by the connecting fabric and a side wall of the flexible magnetic strip.

Optionally, a cross-section of the insertion portion has an arrow shape, the limiting protrusion includes a head of the arrow shape, and the limiting cavity is triangular in shape to match the head of the arrow shape, for wrapping around the limiting protrusion.

Optionally, the flexible magnetic strip has a thickness of 0.5 mm-3 mm, a width of 15 mm-30 mm, and a length of 230 mm-500 mm.

Optionally, reserved grooves are respectively formed on adjacent side surfaces of ends of the two magnetic coupling portions that are away from the limiting cavity, and the two reserved grooves form a second gap when the two magnetic coupling portions are attracted and fit together.

Optionally, the mounting component further includes a connector, one end of the connector is configured to be connected to the main body of the clothing, and the other end of the connector is connected to the accommodating portion.

Optionally, the mounting component is sewn or detachably connected to the main body of the clothing.

Optionally, at least a portion of the main body of the accessory extends toward a side of the mounting component to cover the mounting component.

The present disclosure provides a garment, including:

a main body of the garment; and the detachable clothing assembly as described above, where the mounting component of the detachable clothing assembly is sewn or detachably connected to the main body of the garment.

Optionally, the mounting component includes a collar stand, the accessory includes a collar face, and the collar face is detachably connected to the collar stand.

Optionally, the mounting component includes an armhole, the accessory includes a cuff, and the cuff is detachably connected to the armhole.

Optionally, the mounting component includes a collar stand, the accessory includes a hood, and the hood is detachably connected to the collar stand.

Optionally, the mounting component includes a collar stand, the accessory includes a neckerchief, and the neckerchief is detachably connected to the collar stand.

The disclosure further provides a clothing connection method including:

moving paired flexible magnetic strips provided on the clothing away from each other to allow an insertion portion of an accessory to be inserted into a gap between the flexible magnetic strips; and forming a coupling with the insertion portion through a mutual attraction between the flexible magnetic strips to limit a position of the accessory.

Optionally, the step of forming the coupling with the insertion portion through the magnetic attraction between the flexible magnetic strips includes:

passing a limiting protrusion at an end of the insertion portion from one side of the flexible magnetic strip to the other side of the flexible magnetic strip, and limiting a position of the limiting protrusion by a side portion of the flexible magnetic strip.

Optionally, the step of forming the coupling with the insertion portion through the magnetic attraction between the flexible magnetic strips further includes:

enclosing a limiting cavity by the flexible magnetic strips and fabric of the clothing, and causing the limiting cavity to surround the limiting protrusion through the mutual attraction between the flexible magnetic strips.

The detachable clothing assembly disclosed herein operates by separating two magnetic coupling portions on the mounting component to create a first gap therebetween. The insertion portion of the accessory is matched with the first gap to be inserted into the first gap, and is limited by the magnetic coupling portion when the two magnetic coupling portions attract each other, so as to achieve a quick connection between the accessory and the mounting component. When disassembling, simply open the two magnetic coupling portions to take out the insertion portion of the accessory and separate the accessory from the insertion portion. When this assembly is used for the connection between the collar or the cuff and the garment, the operation is simple and convenient, enabling quick assembly and disassembly, avoiding the cumbersome operation of traditional buttons or zippers. Moreover, the mutual attraction of the magnetic coupling portions limits the collar or the cuff, improving the connection strength between the collar or the cuff and the garment, effectively preventing the collar or the cuff from falling off due to being pulled, and enhancing the stability of the clothing connection.

For the garment provided in the present application, the detachable connection between the collar or the cuff and the garment is realized through the above-mentioned detachable clothing assembly. While having all the above-mentioned advantages, consumers can replace the collar and the cuff by themselves, thereby reducing waste, protecting the environment, and endowing the garment with variability and interest.

The clothing connection method provided in the present application also has all the above-mentioned advantages.

BRIEF DESCRIPTION OF THE DRAWINGS

To clarify the embodiments of the present application, the accompanying drawings will be briefly described. It should be understood that these drawings merely illustrate representative embodiments, and persons skilled in the art may derive numerous additional technical features and structural relationships not explicitly discussed herein.

REFERENCE NUMERALS

Figure 1:
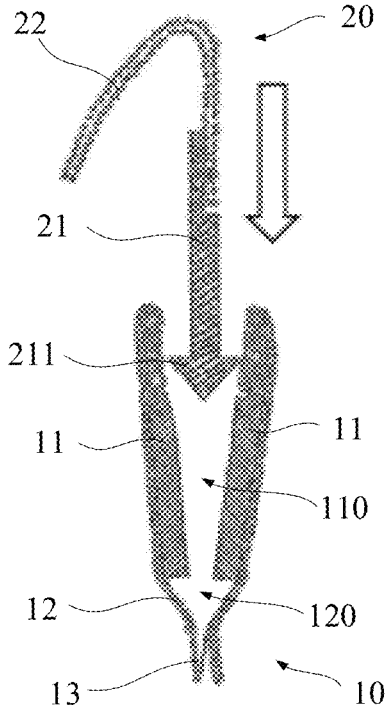
FIG. 1 is a schematic cross-sectional structure diagram of a detachable clothing assembly of the present application in an inserted state.

10: Mounting component; 11: Magnetic coupling portion; 110: First gap; 111: Reserved groove; 112: Second gap; 12: Receiving portion; 120: Limiting cavity; 121: Connecting fabric; 13: Connecting portion; 20: Accessory; 21: Insertion portion; 211: Limiting protrusion; 212: Extension section; 22: Main body of the accessory; 30: Main body of the clothing; 40: Collar stand; 50: Collar face; 60: Armhole; 70: Cuff; 71: Extension portion; 80: Hood.

DETAILED DESCRIPTION

To make the objectives, technical solutions, and advantages of the embodiments of the present invention more comprehensible, the technical solutions in the embodiments will be described clearly and completely hereinafter with reference to the accompanying drawings. It should be understood that the described embodiments represent some embodiments of the present invention rather than all possible implementations. All other embodiments obtained by persons of ordinary skill in the art based on the embodiments herein without creative efforts shall fall within the protection scope of the present invention.

In the description of embodiments of the present invention, it should be noted that orientation-related terms such as "center", "longitudinal", "transverse", "upper", "lower", "front", "rear", "left", "right", "vertical", "horizontal", "top", "bottom", "inner", and "outer" refer to orientations or positional relationships based on those illustrated in the accompanying drawings. These terms are used solely to facilitate description of the embodiments and simplify explanation, and do not imply that the referenced apparatus or element must maintain a particular orientation or be configured/operated in a specific manner. Therefore, such terms should not be construed as limiting the scope of the invention. Additionally, numerical designations such as "first", "second", and "third" serve descriptive purposes only and do not denote relative importance.

In describing embodiments of the present invention, unless expressly specified or contextually limited otherwise, the terms "connected" and "coupled" should be interpreted broadly. Such connections may include, but are not limited to: permanent or detachable connections; integral or mechanical couplings; electrical interconnections; direct linkages; or indirect connections through intermediary components. Those skilled in the art will appreciate the contextual interpretation of these terms within the technical scope of the present disclosure.

The technical solutions of embodiments in the present application will be described in detail below with reference to the accompanying drawings.

Embodiment 1

The present embodiment provides a detachable clothing assembly including a mounting component 10 and an accessory 20 configured for detachable interconnection. The mounting component 10 is adapted for attachment to a main body of the clothing, while the accessory 20 serves as a functional or decorative element attachable to the main body of the clothing. This assembly enables reversible attachment/detachment of accessories relative to the main body of the clothing, thereby fulfilling user requirements for modular customization.

As illustrated in FIG. 1, the mounting component 10 incorporates two opposed magnetic coupling portions 11. These magnetic coupling portions 11 may either protrude from the garment surface or be disposed at terminal positions of the main body of the clothing, maintaining parallel alignment. The magnetic coupling portions 11 are movably configured to permit separation (creating a first gap 110) and magnetic reengagement (closing the first gap 110) through reciprocal displacement.

Figure 5:
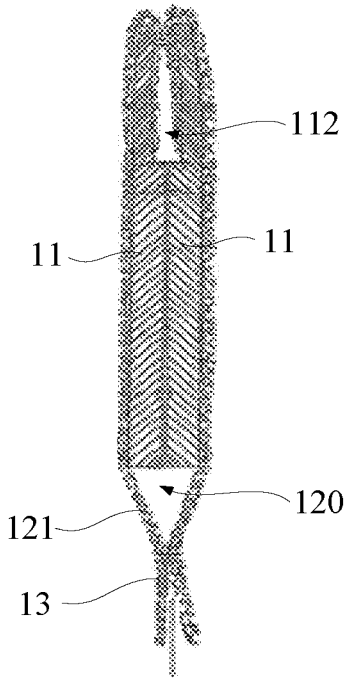
FIG. 5 is a schematic cross-sectional structure diagram of the mounting component of the present application in a closed state.

FIG. 5 demonstrates the engaged state where the magnetic coupling portions 11 are magnetically coupled, effectively eliminating first gap 110 through surface contact.

In this embodiment, the mounting component 10 extends along a predetermined length on the main body of the clothing surface, thereby configuring the two magnetic coupling portions 11 in an elongated strip configuration. This structural arrangement creates defined clamping surfaces during magnetic coupling, significantly enhancing the stability of the magnetic engagement.

Referring to FIG. 1, the accessory 20 of this embodiment includes a main body of the accessory 22 and an insertion assembly 21 disposed at one extremity of the main body. The insertion assembly 21 is dimensioned with an extension length corresponding to that of the magnetic coupling portions 11, and is specifically configured to be accommodated within the previously mentioned first gap 110.

Figure 2:
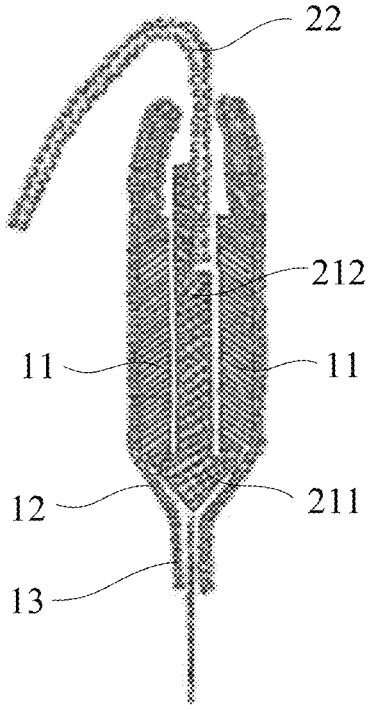
FIG. 2 is a schematic cross-sectional structure diagram of the detachable clothing assembly of the present application in a connected state.

As depicted in FIG. 1, separation of the magnetic coupling portions 11 permits insertion of the insertion assembly 21 into the first gap 110 (insertion direction indicated by arrow). Subsequent magnetic coupling of the magnetic coupling portions 11, as shown in FIG. 2, results in the insertion assembly 21 being captured between the magnetic coupling portions 11. This positive retention mechanism, where at least a portion of the insertion assembly remains constrained between the coupled members, effectively prevents accidental dislodgement, thereby establishing a secure connection between the accessory 20 and mounting component 10.

Figure 3:
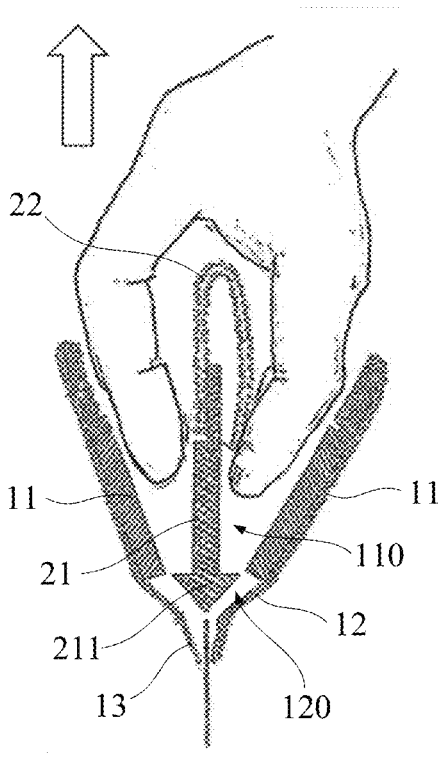
FIG. 3 is a schematic cross-sectional structure diagram of the detachable clothing assembly of the present application in a disassembled state.

FIG. 3 illustrates the disassembly procedure: separation of the magnetically coupled magnetic coupling portions 11 disengages the insertion assembly 21 from magnetic retention, enabling straightforward extraction of the accessory 20 (extraction direction indicated by arrow). This operational sequence achieves rapid component separation without requiring tool intervention.

The disclosed detachable garment system achieves component attachment/detachment through intuitive magnetic coupling and mechanical insertion protocols. This innovative connection methodology provides substantial operational advantages over conventional closure mechanisms (e.g., buttons, zippers), particularly in terms of engagement reliability and ease of component interchangeability.

With reference to FIGS. 1-2, the insertion assembly 21 incorporates an extension section 212 connecting to the main body of the accessory 22 and a limiting protrusion 211 disposed at the distal end. The limiting protrusion 211 is configured to interlock with the magnetically coupled magnetic coupling portions 11, establishing positive positional registration that secures the accessory against unintended separation from the mounting component during operational use.

Notably, in this embodiment, when the insertion portion 21 is not engaged, the two magnetic coupling portions 11 magnetically contact and adhere to each other, causing the first gap 110 to close and be eliminated. Upon insertion of the insertion portion 21 between the magnetic coupling portions 11, the members magnetically adhere to opposing surfaces of the insertion portion 21, thereby securely clamping it through magnetic attraction. This clamping force concurrently provides a positioning function.

In the present embodiment, the extension section 212 has a depth-direction length equal to or exceeding that of the first gap 110. Consequently, when the insertion portion 21 is inserted into the first gap 110, the limiting protrusion 211 extends completely through the magnetic coupling portion 11 from one side to the other, with its movement constrained by the side surfaces of the magnetic coupling portion.

As illustrated in FIG. 2, the limiting protrusion 211 protrudes beyond the magnetic coupling portion 11. During magnetic clamping of the extension section 212 by the magnetic coupling portions 11, a lateral surface of the limiting protrusion 211 engages with the corresponding side surface of the magnetic coupling portion 11, creating a mechanical stop that prevents outward displacement of the limiting protrusion.

In a preferred embodiment, the mounting component 10 further includes a receiving portion 12 connected to the magnetic coupling portion 11. This receiving portion 12 defines a limiting cavity 120 on the main body of the clothing-proximal side of the magnetic coupling portion 11.

During insertion into the first gap 110, the limiting protrusion 211 projects into and is fully contained within the limiting cavity.

Referring to FIGS. 1-3, the limiting cavity 120 is positioned at a terminal end of the magnetic coupling portion 11. Separation of the magnetic coupling portions 11 opens both the first gap 110 and limiting cavity 120, establishing communication therebetween for limiting protrusion 211 insertion. Upon magnetic engagement with the extension section 212, the limiting cavity 120 becomes enclosed, with the magnetic coupling portion's side walls completely surrounding the limiting protrusion 211. This configuration provides additional restraint against displacement while enhancing operational stability.

In certain implementations, the receiving portion 12 includes a connection textile 121 configured for dual functionality: attachment to both the garment substrate and the magnetic coupling portion 11.

Figure 4:
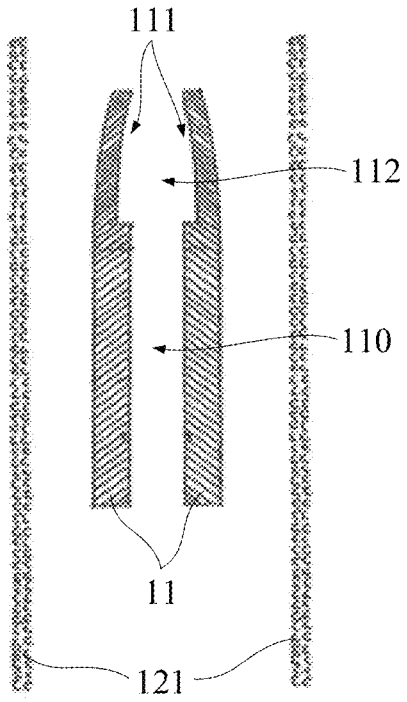
FIG. 4 is a schematic cross-sectional structure diagram of a mounting component of the present application in a disassembled state.
Figure 6:
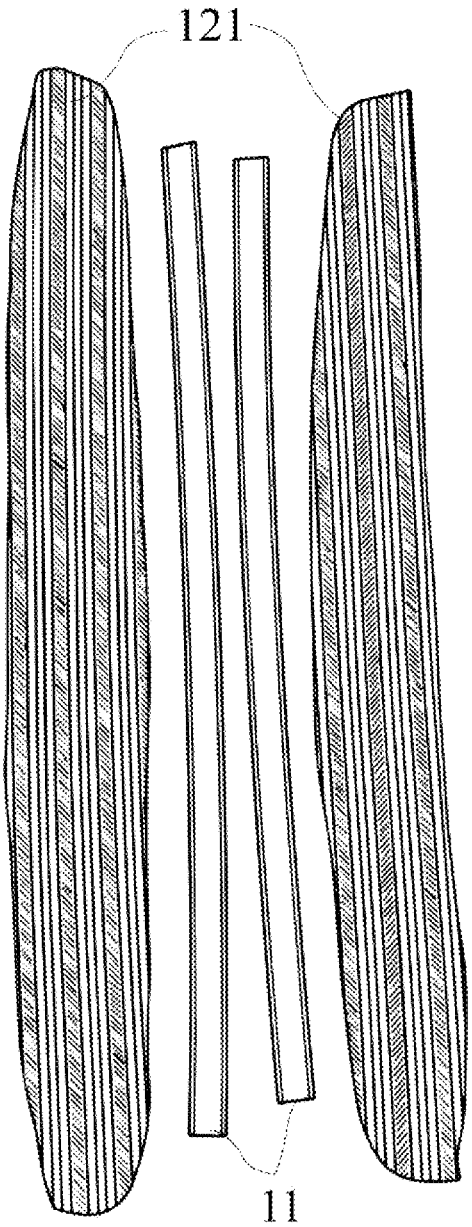
FIG. 6 is a physical diagram of a collar stand of the present application in an exploded state.

As illustrated in FIGS. 4-6, the accommodation portion 12 includes connecting fabric 121. The magnetic assembly 11 is implemented as a flexible magnetic strip sewn onto or embedded within the connecting fabric 121. Through this connecting fabric 121, the magnetic assembly 11 connects to the main body of the clothing while maintaining flexible pivotability, thereby enabling the aforementioned operational motions of spreading apart, magnetically closing, or clamping.

Accordingly, the limiting cavity 120 in this embodiment constitutes a spatial volume bounded by the connecting fabric 121 and lateral surfaces of the flexible magnetic strip. With reference to FIG. 5, the two connecting fabrics 121 are joined or sewn at one terminal end, while their opposite ends respectively connect to flexible magnetic strips. Given that the magnetic strips exhibit greater thickness than the connecting fabric 121, mutual magnetic engagement between the two flexible magnetic strips causes their lateral walls and the extended fabric portions beyond the magnetic strips to cooperatively form an enclosed limiting cavity 120.

In an exemplary implementation, the flexible magnetic strip demonstrates dimensional parameters of: thickness 0.5-3 mm, width 15-30 mm, and length 230-500 mm. These specifications ensure ergonomic finger operation while maintaining unimpaired garment functionality.

The present embodiment configures the limiting cavity 120 with dimensional correspondence to the limiting protrusion 211, enabling complete circumferential enclosure and secure envelopment of the protrusion. This configuration effectively prevents relative displacement between the limiting protrusion 211 and the flexible magnetic strip, thereby enhancing connection stability.

Figure 8:
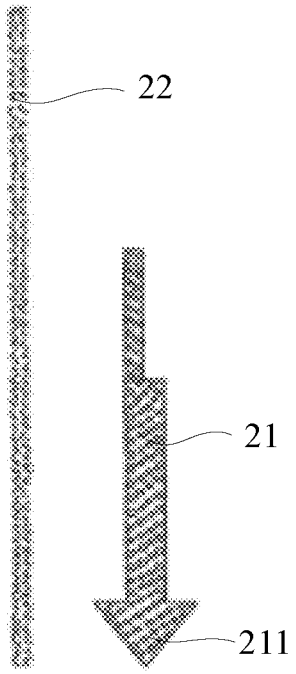
FIG. 8 is a schematic cross-sectional structure diagram of an accessory of the present application in an exploded state.
Figure 9:
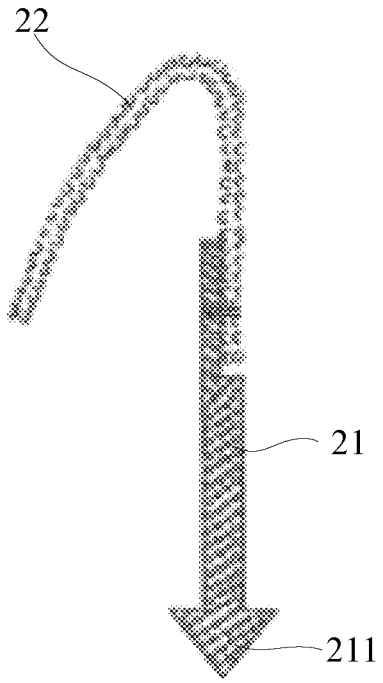
FIG. 9 is a schematic cross-sectional structure diagram of the accessory of the present application in an assembled state.

As shown in FIGS. 8-9, the insertion portion 21 features an arrowhead-shaped cross-sectional configuration where the limiting protrusion 211 constitutes the arrowhead portion. Correspondingly, FIG. 5 illustrates that the limiting cavity 120 adopts a triangular geometry complementary to the arrowhead profile, ensuring stable encapsulation of the Limiting protrusion 211.

It is noteworthy that the arrowhead cross-sectional design of the insertion portion 21 additionally facilitates guided entry into the first gap 110, providing directional alignment functionality.

Building upon this configuration, the current embodiment incorporates further refinements to the magnetic assembly 11 to optimize insertion of the insertion portion 21 into the first gap 110.

As depicted in FIGS. 4-5, adjacent lateral surfaces of the two magnetic assemblies 11 distal from the limiting cavity 120 are provided with reserved grooves 111. When the magnetic assemblies 11 are brought into magnetic engagement, these reserved grooves 111 cooperatively define a secondary gap 112 extending to the terminal ends of the magnetic assemblies.

That is, the cross-section of the flexible magnetic strip is formed into a "b" shape. When the two magnetic coupling portions 11 are magnetically attracted into contact, the presence of the second gap 112 allows consumers to easily separate the magnetic coupling portions 11 with their fingers, thereby facilitating installation of the accessory 20.

Without the second gap 112, the two magnetic coupling portions 11 would adhere completely when attracted, leaving no separation space. This would make it difficult for users to pry apart the magnetic coupling portions 11 manually, resulting in increased operational effort.

Furthermore, the second gap 112 serves an additional purpose: extending to communicate with the first gap 110, the arrow-shaped insertion portion 21 can be directly guided into the second gap 112. The tapered profile of the insertion portion 21 naturally spreads apart the magnetic coupling portions 11, enabling smooth insertion into the first gap 110 and ensuring rapid alignment.

As illustrated in FIGS. 8 and 9, the insertion portion 21 may be either stitched to or integrally formed with the main body of the accessory 22. The thickness of the insertion portion 21 should maintain sufficient magnetic attraction between the flexible magnetic strips while clamping, though reduced thickness enhances magnetic performance. Optimal thickness balancing structural integrity and magnetic efficiency should be employed.

It should be noted that the insertion portion 21 is not limited to an arrow-shaped configuration, nor must the limiting protrusion 211 be positioned at its tip. Any structure enabling cooperative engagement with the magnetic coupling portions 11 to prevent displacement toward the insertion direction would suffice.

In an alternative embodiment, mutually opposed surfaces of the magnetic coupling portions 11 may incorporate retaining grooves. Corresponding limiting protrusions 211 on lateral surfaces of the insertion portion 21 engage these grooves when the magnetic coupling portions 11 clamp the insertion portion 21, thereby achieving positional locking.

In the present embodiment, the mounting component 10 is either stitched or detachably connected to the main body of the clothing. Specifically, the flexible magnetic strip connects to a connecting fabric 121, which interfaces directly with the main body of the clothing through either permanent stitching or removable fastening means.

In one embodiment, as shown in FIGS. 1-3, the mounting component 10 further includes a connecting portion 13. A first end of the connecting portion 13 is configured for attachment to a main body of the clothing, while a second end connects to the accommodation portion 12. The connecting fabric 121 may also be secured to the main body of the clothing through the connecting portion 13, which functions as a connection base structure for joining two connecting fabrics 121 and stitching them together to enclose the limiting cavity 120. The connecting portion 13 may employ a fabric structure sewn to the main body of the clothing or alternatively adopt a detachable connection mechanism for engagement with the main body of the clothing.

The detachable clothing assembly of the present embodiment enables rapid connection between the accessory 20 and mounting component 10 through the following mechanism: When the two magnetic coupling portions 11 on the mounting component 10 are separated to form a first gap 110 therebetween, the insertion portion 21 of the accessory 20, being dimensionally compatible with the first gap 110, is inserted therein. Subsequent magnetic engagement between the two magnetic coupling portions 11 effectively retains the insertion portion 21 in position. For disassembly, the magnetic coupling portions 11 may be manually separated to permit withdrawal of the insertion portion 21, thereby detaching the accessory 20 from the mounting component 10.

The detachable clothing assembly disclosed in this embodiment finds application not only in various clothing including garments, trousers, footwear, and headwear, but also extends to accessories such as backpacks and other textile products, addressing the need for detachability between primary articles and their complementary accessories.

Figure 7:
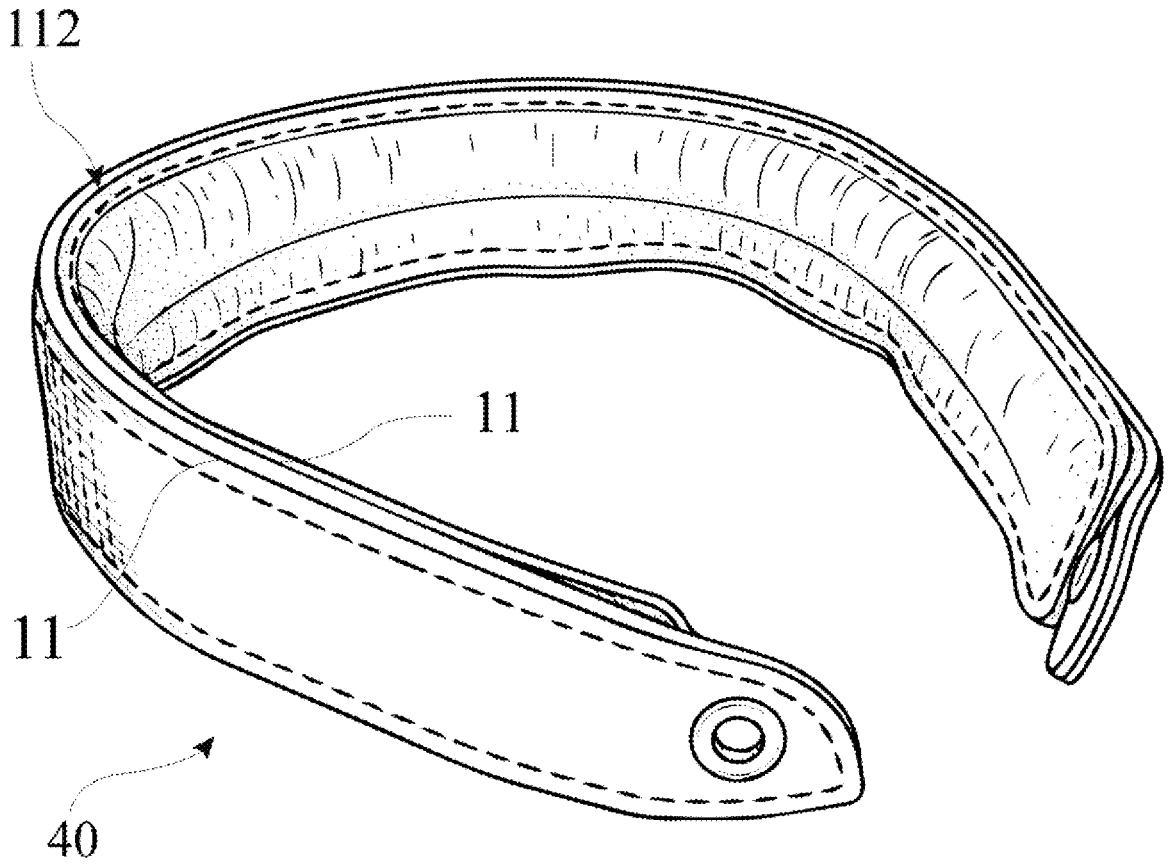
FIG. 7 is a physical diagram of the collar stand of the present application.
Figure 10:
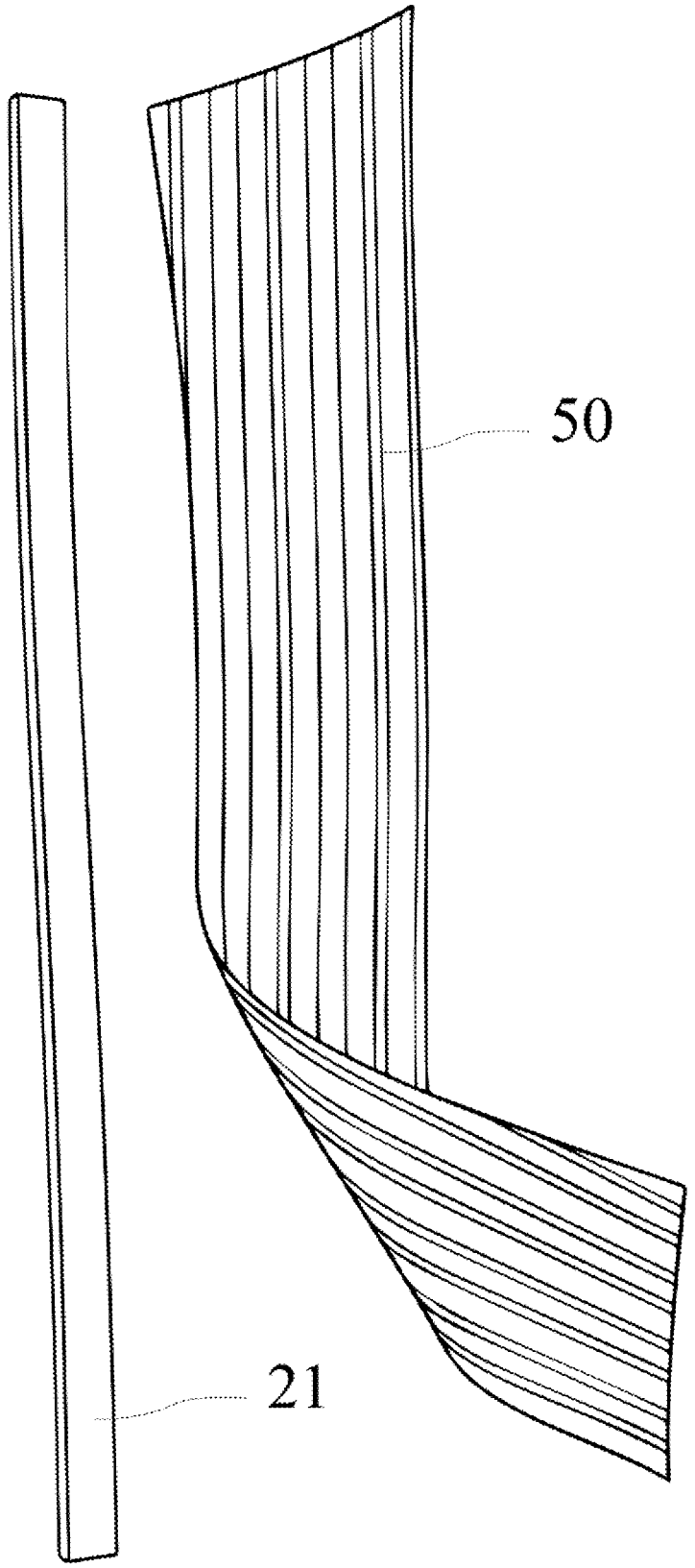
FIG. 10 is a physical diagram of a collar face of the present application in an exploded state.
Figure 11:
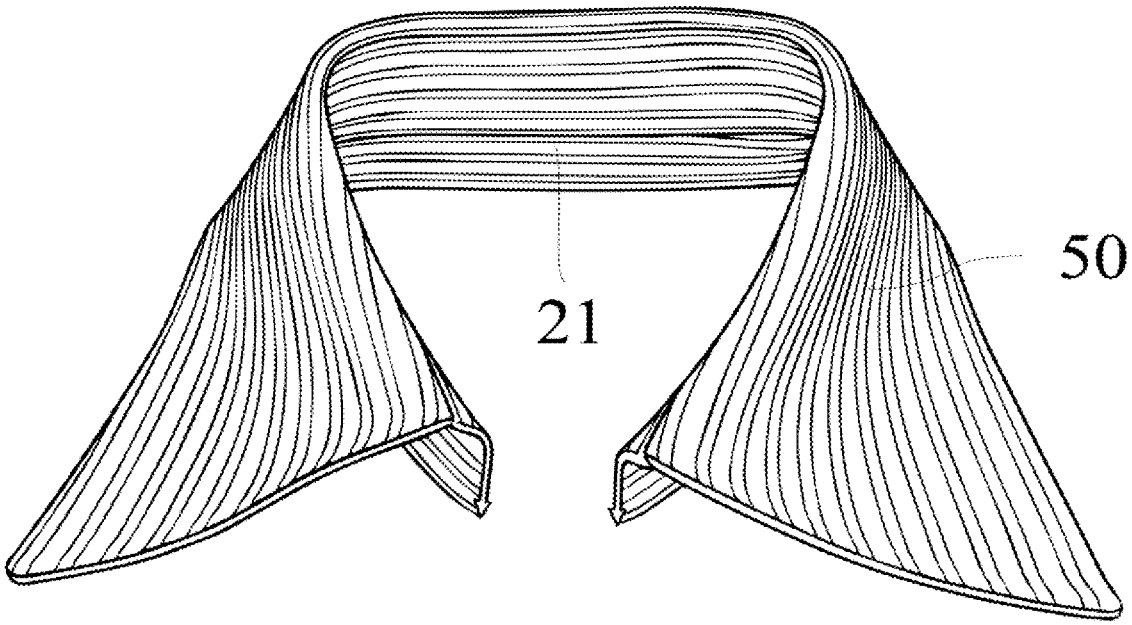
FIG. 11 is a physical diagram of the collar face of the present application.
Figure 13:
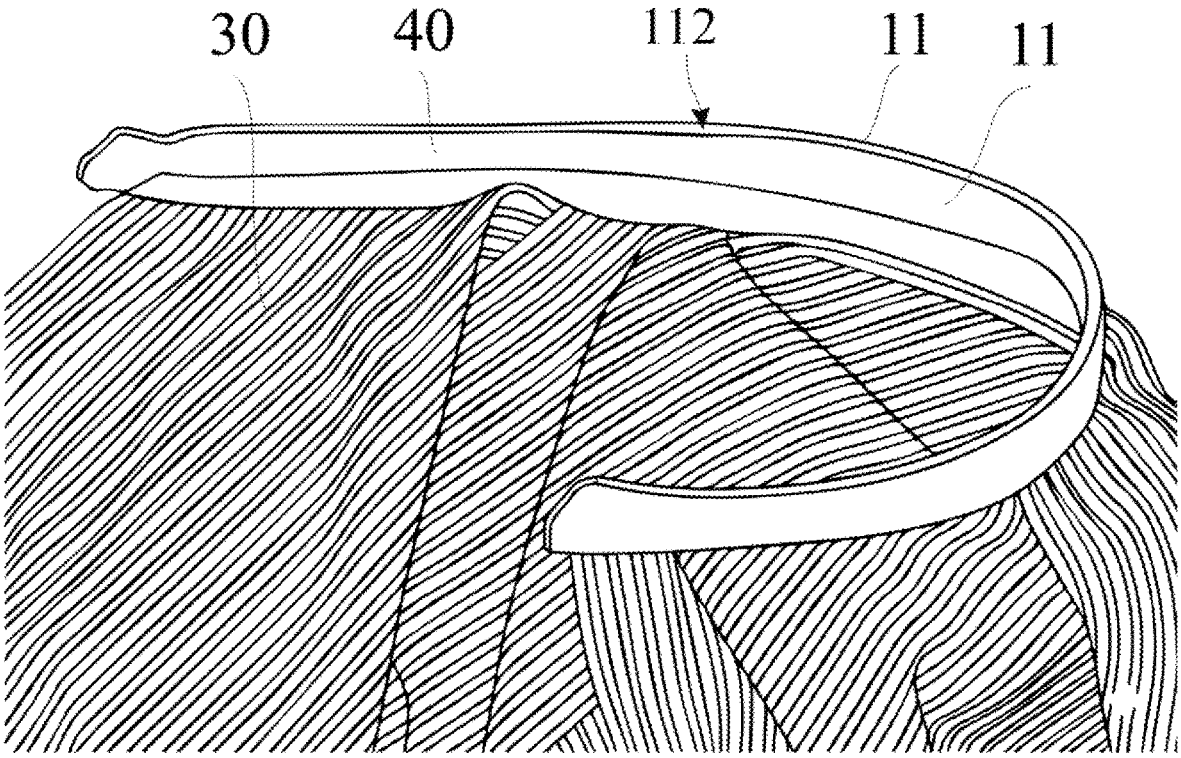
FIG. 13 is a physical diagram of the collar stand part of the garment of the present application.
Figure 14:
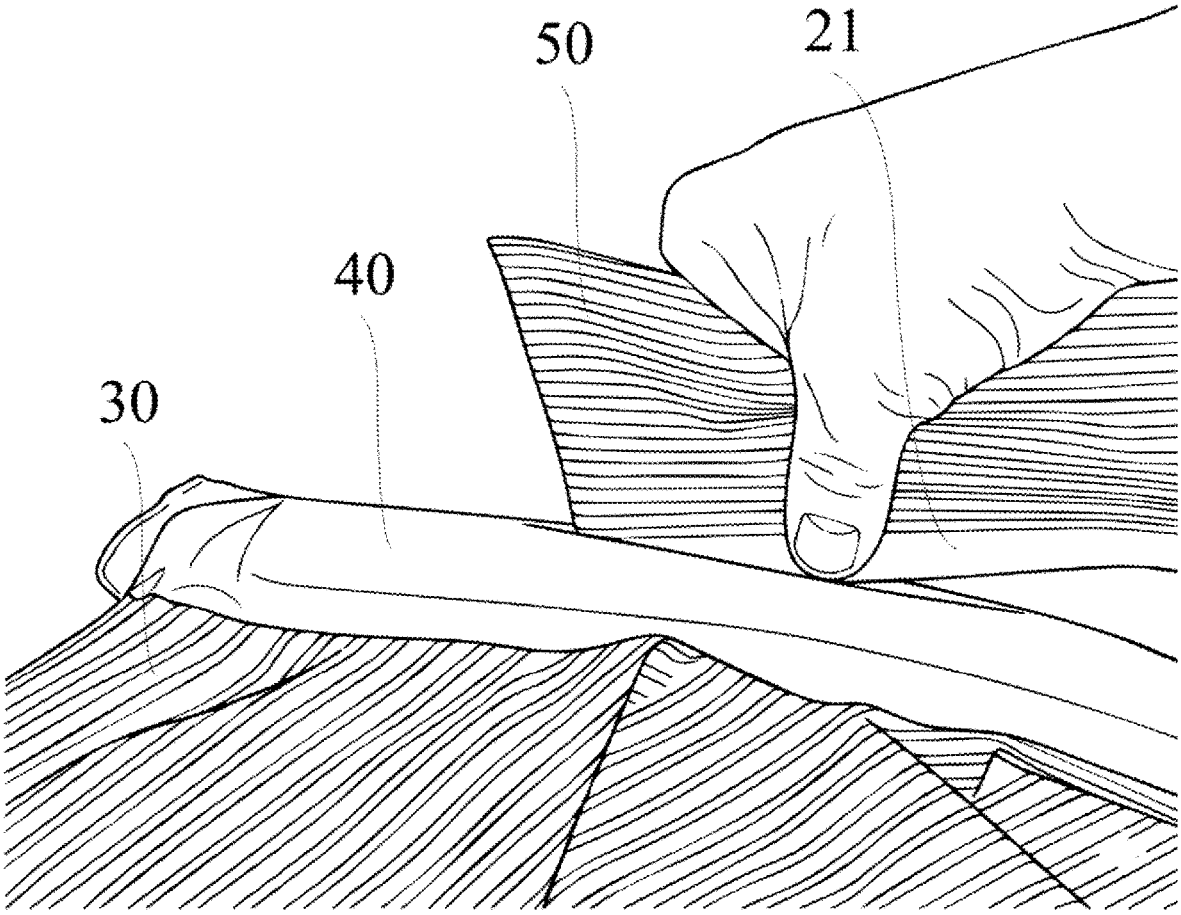
FIG. 14 is a physical diagram of the garment of the present application when the collar face is installed.
Figure 15:
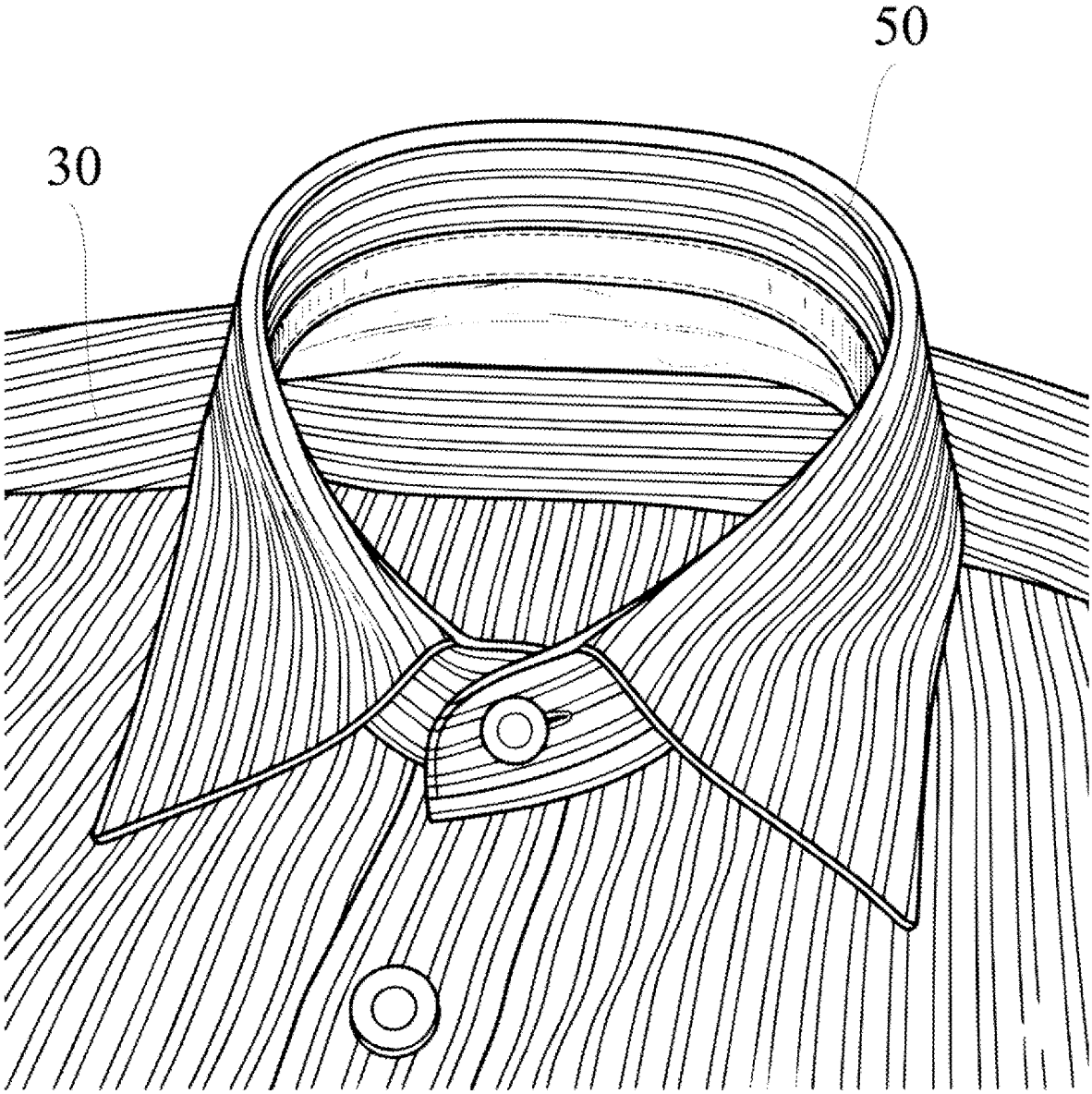
FIG. 15 is a physical diagram of the garment of the present application after the collar face is installed.

As illustrated in FIGS. 13-15, taking garment implementation as an exemplary application, this embodiment achieves detachable functionality for collars and cuffs. In this configuration (FIGS. 6-7), the mounting component 10 may constitute a collar stand 40 of a garment, with the accessory 20 serving as a collar assembly. As depicted in FIGS. 10-11, the main body of the accessory 22 corresponds to the collar face 50, thereby enabling detachable collar functionality.

Figure 12:
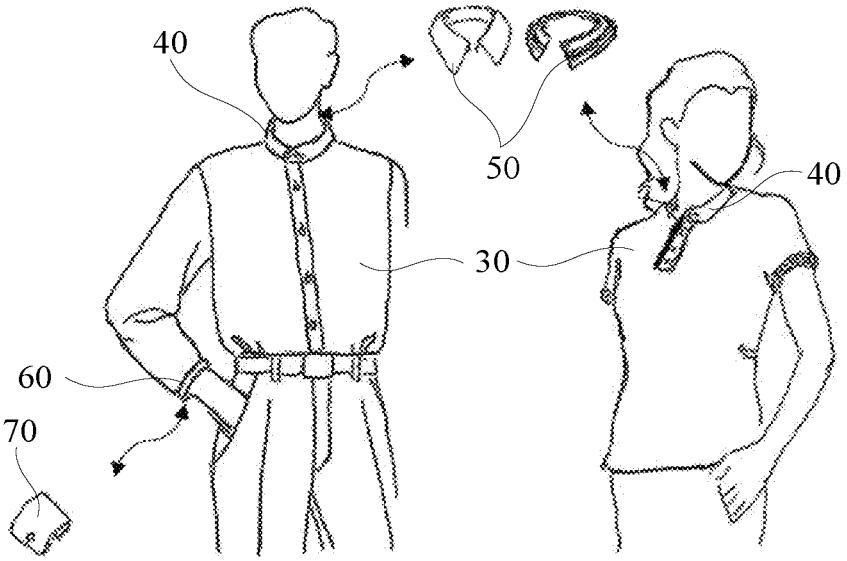
FIG. 12 is a structural schematic diagram of a garment of the present application.
Figure 16:
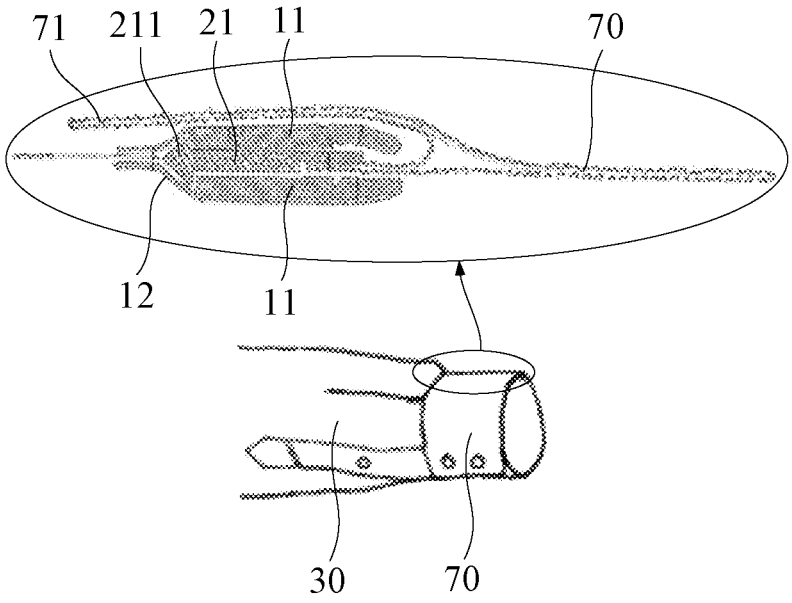
FIG. 16 is a structural schematic diagram of an embodiment of the cuff of the present application.
Figure 17:
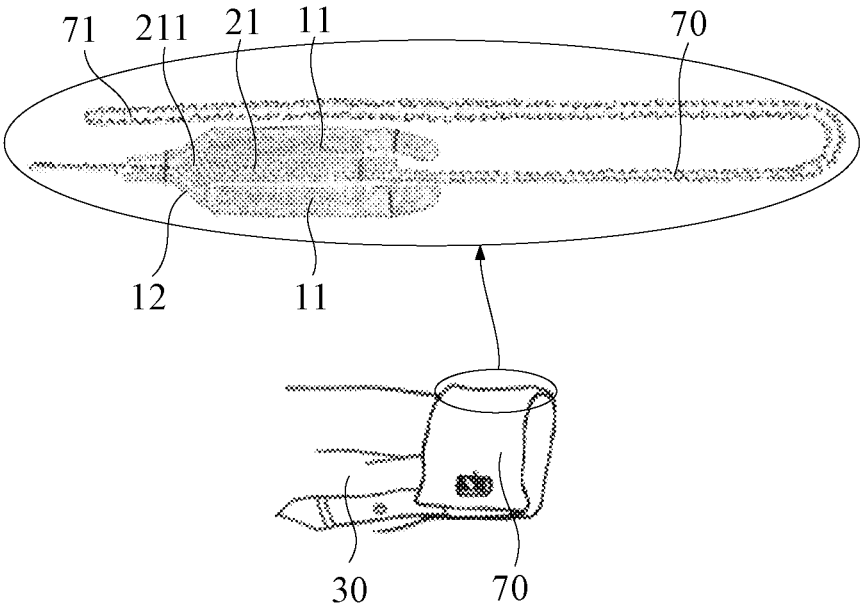
FIG. 17 is a structural schematic diagram of another embodiment of the cuff of the present application.

Referring to FIGS. 12, 16, and 17, the mounting component 10 may alternatively be implemented as an armhole 60 of a garment, where the main body of the accessory 22 constitutes a detachable cuff 70, thereby providing removable cuff functionality.

Figure 18:
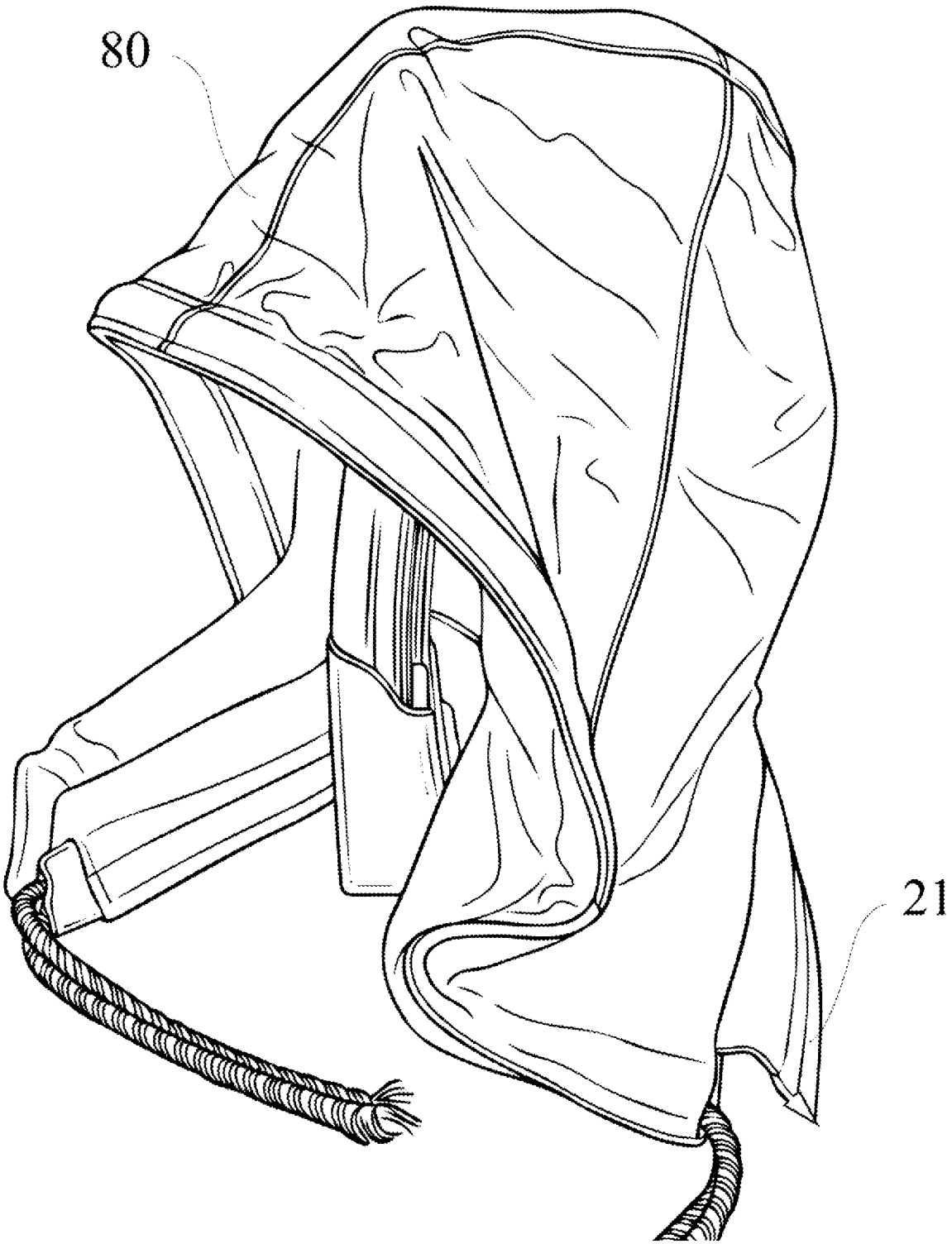
FIG. 18 is a structural schematic diagram of a hood of the present application.

In another embodiment shown in FIG. 18, the main body of the accessory 22 may include a hood 80 having an insertion portion 21 at one end. Through engagement of this insertion portion 21 with the collar stand 40, the hood 80 achieves detachable connection, facilitating interchangeable use between hood and collar configurations to enhance garment versatility.

In a further embodiment, the clothing assembly may be adapted to sleeves of garments or legs of trousers, enabling conversion between long-sleeve, short-sleeve, and sleeveless configurations for upper-body garments, or providing adjustable length options for lower-body garments ranging from full-length trousers to mid-length and short versions.

In one embodiment, at least a portion of the main body of the accessory 22 extends toward the mounting component 10 to conceal the mounting component 10. As shown in FIGS. 16 and 17, an extension portion 71 is formed at one end of the cuff 70, extending toward the main body of the garment 30. When the cuff 70 is mounted on the armhole 60, the extension portion 71 covers connection areas between the cuff 70 and armhole 60, thereby concealing the connection points and meeting aesthetic requirements.

As illustrated in FIG. 12, the detachable clothing assembly of this embodiment facilitates connection of collars or cuffs to a garment. The assembly enables simple and rapid attachment/detachment, eliminating complex operations associated with traditional buttons or zippers. Magnetic coupling portions 11 mutually attract to secure the collar or cuff in position, enhancing connection strength between the collar/cuff and garment. This configuration effectively prevents disengagement due to external pulling forces, thereby improving connection stability.

Embodiment 2

The present embodiment provides a garment including a main body of the garment 30 and the detachable clothing assembly described in previous embodiments. The mounting component 10 of the assembly is either permanently stitched or detachably connected to the main body of the garment 30.

As shown in FIGS. 12-15, the mounting component 10 may constitute a collar stand 40, while the accessory 20 may include a collar face 50. The collar face 50 is detachably engageable with the collar stand 40.

FIGS. 16 and 17 demonstrate an implementation where the mounting component 10 includes an armhole 60 and the accessory 20 includes a cuff 70, with the cuff 70 being detachably connectable to the armhole 60.

As depicted in FIG. 18, the mounting component 10 may alternatively serve as a collar stand 40 for detachably connecting a hood 80, allowing interchangeable use with the collar face 50.

Similarly, the accessory 20 may be configured as a scarf detachably connectable to the collar stand 40.

By employing the disclosed detachable clothing assembly, the garment of this embodiment enables removable connections between various garment elements and the main body. This configuration not only retains the advantages of easy detachment and robust connection mentioned in previous embodiments-facilitating localized maintenance/cleaning and reducing material waste—but also introduces modular versatility and enhanced aesthetic appeal, thereby increasing the garment's functional and commercial value.

Embodiment 3

Figure 19:
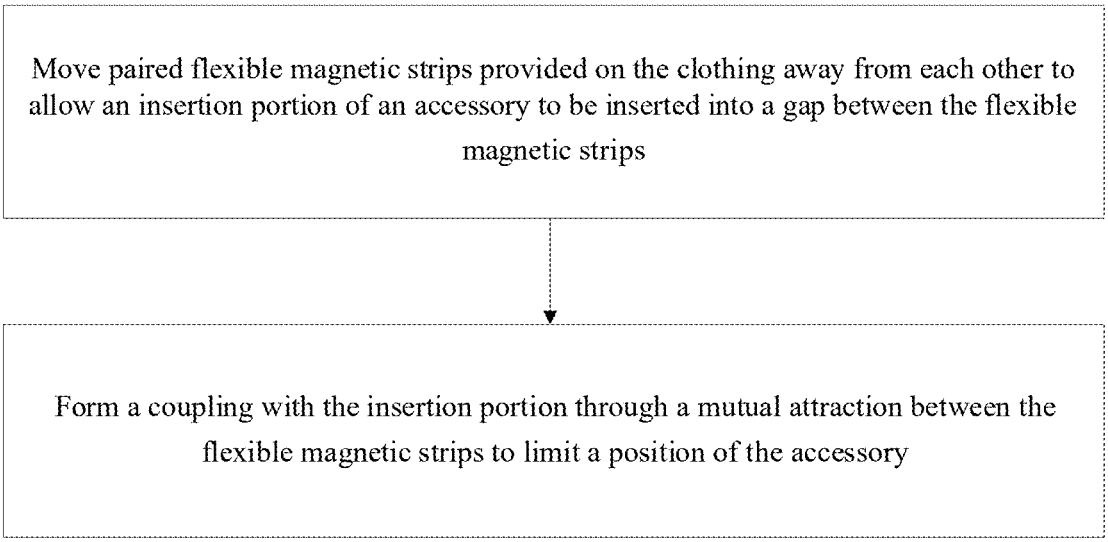
FIG. 19 is a flowchart of steps of a clothing connection method of the present application.

As shown in FIG. 19, this embodiment discloses a clothing connection method including the following steps.

In step 1, paired flexible magnetic strips provided on the clothing are moved away from each other to allow an insertion portion 21 of an accessory 20 to be inserted into a gap between the flexible magnetic strips.

In step 2, a coupling is formed with the insertion portion 21 through a mutual attraction between the flexible magnetic strips to limit a position of the accessory 20.

In this step, the limiting protrusion 211 at the distal end of the insertion portion 21 passes through from one lateral surface of the flexible magnetic strip to the opposite lateral surface, where the lateral surfaces of the flexible magnetic strip restrict movement of the limiting protrusion 211.

In the aforementioned step of establishing a coupling relationship through mutual magnetic attraction between the flexible magnetic strips and the insertion portion 21:

- a limiting cavity 120 is enclosed by the flexible magnetic strips and garment fabric, where the mutual magnetic attraction of the flexible magnetic strips enables the limiting cavity 120 to circumferentially encompass the limiting protrusion 211.

Specifically, two paired flexible magnetic strips are disposed at predetermined positions on the garment, preferably secured to the garment fabric through stitching. The two flexible magnetic strips are separable to create a first gap 110 therebetween, into which the insertion portion 21 of the accessory 20 can be engaged.

The insertion portion 21 is provided with a limiting protrusion 211 at its terminal end. Upon insertion of the insertion portion 21 into the first gap 110, the limiting protrusion 211 extends beyond the flexible magnetic strips. When the two flexible magnetic strips magnetically attract and grip the insertion portion 21, their lateral surfaces restrain the limiting protrusion 211 from external disengagement. Furthermore, during magnetic attraction of the flexible magnetic strips, the interconnected fabric and magnetic strips cooperatively define the limiting cavity 120, which fully encapsulates the limiting protrusion 211. This snug encasement within the limiting cavity 120 prevents positional deviation of the limiting protrusion 211, thereby improving structural stability between the insertion portion 21 and the flexible magnetic strips.

For accessory 20 detachment, consumers need only apply digital separation force to the flexible magnetic strips to disengage and extract the insertion portion 21.

This connection method, when implemented in clothing connection, provides rapid and secure attachment/detachment functionality between the main body of the clothing and accessories. The design offers consumers enhanced convenience and novel user experiences while maintaining connection integrity under tensile stresses, satisfying garment durability requirements and demonstrating significant practical utility.

Figure 20:
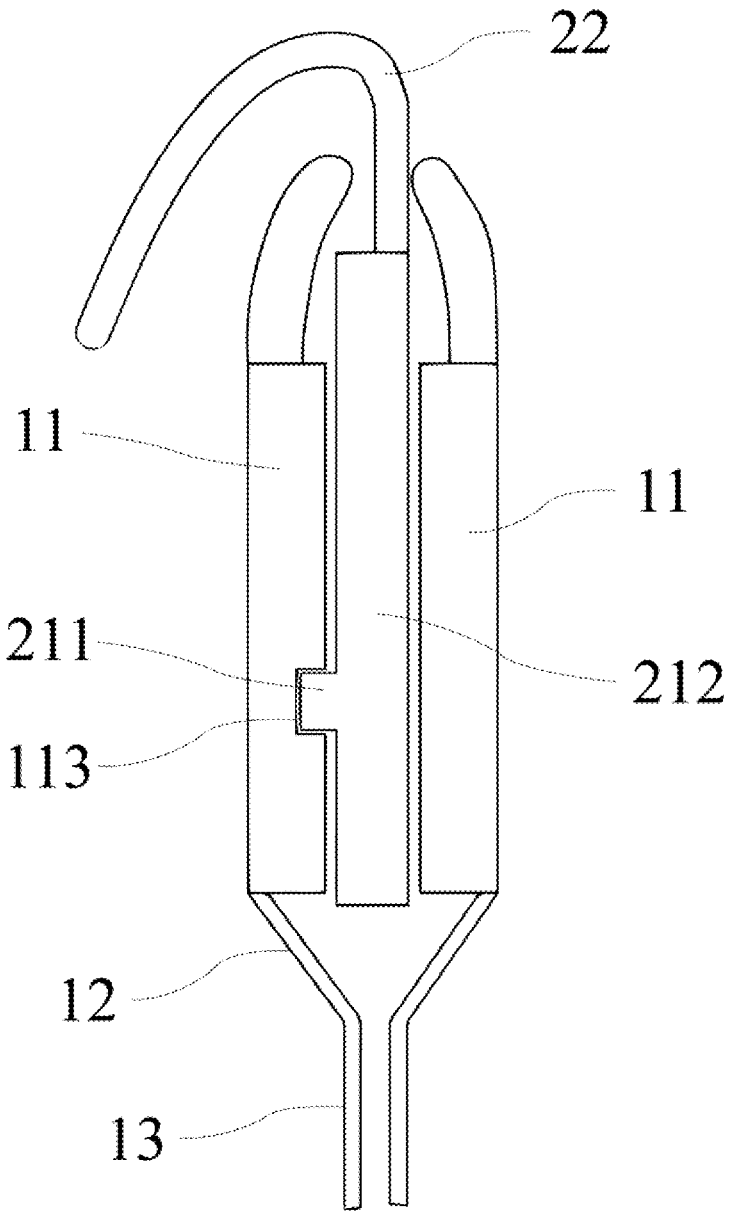
FIG. 20 is a schematic cross-sectional structure diagram of the magnetic coupling portions and the insertion portion, illustrating the snap-fit engagement between the limiting protrusion and the limiting grooves according to an embodiment of the present application.

FIG. 20 illustrates a detailed engagement mechanism of the detachable clothing assembly. As shown in FIG. 20, the magnetic coupling portions (11) are provided with limiting grooves (113) recessed into their mutually opposed surfaces. When the insertion portion (21) is inserted into the first gap (110) between the magnetic coupling portions (11), the limiting protrusion (211) disposed at the distal end of the extension section (212) is configured to snap into the limiting grooves (113). This snap-fit cooperation, in conjunction with the magnetic attraction between the magnetic coupling portions (11), provides additional mechanical retention and positional registration for the accessory relative to the mounting component.

In the embodiments of the present invention, unless otherwise expressly specified and defined, the description of a first feature being "on" or "under" a second feature may encompass both direct contact between the features and indirect contact through an intermediate medium. Furthermore, the terms "over", "above", or "on top of" regarding the first feature relative to the second feature may indicate either vertical or oblique positioning above the second feature, or may simply denote that the first feature has a higher elevation than the second feature. Conversely, the expressions "under", "below", or "beneath" may describe either vertical or oblique positioning below the second feature, or may merely signify that the first feature has a lower elevation than the second feature.

Throughout this specification, references to terms such as "one embodiment", "some embodiments", "an example", "a specific example", or "some examples" shall be construed to mean that any particular feature, structure, material, or characteristic described in connection with the embodiment or example is incorporated in at least one embodiment or example of the present invention. Descriptive references to these terms in the specification are not necessarily directed to identical embodiments or examples. Moreover, the specific features, structures, materials, or characteristics described herein may be combined in any compatible manner across one or more embodiments or examples. Practitioners skilled in the art may appropriately combine and aggregate features from different embodiments or examples described in this specification, provided such combinations do not create technical contradictions.

It is hereby clarified that: the preceding embodiments are provided solely to elucidate the technical solutions of the present invention and should not be construed as limiting. While the invention has been described in detail with reference to exemplary embodiments, those skilled in the art will appreciate that various modifications to the technical solutions disclosed in these embodiments, or equivalent substitutions of certain technical features, may be implemented without departing from the essential principles and scope defined by the technical solutions of the invention's embodiments.

What is claimed is:

1. A detachable clothing assembly, comprising:

a mounting component, configured to be connected to a main body of the clothing, the mounting component comprising two magnetic coupling portions arranged oppositely and an accommodating portion, wherein the magnetic coupling portions are able to move away from each other to form a first gap between the magnetic coupling portions, and are able to attract each other to close the first gap; and an accessory, comprising a main body of the accessory and an insertion portion arranged at an end of the main body of the accessory, wherein the insertion portion is matched with the first gap to be inserted into the first gap, and is limited by the magnetic coupling portions when the magnetic coupling portions attract each other;

wherein the insertion portion comprises: an extension section connected to the main body of the accessory; and a limiting protrusion provided at an end of the extension section;

wherein a length of the extension section in a depth direction of the first gap is greater than or equal to a depth of the first gap, and the limiting protrusion extends from one side of the magnetic coupling portions to the other side of the magnetic coupling portions and is limited by side portions of the magnetic coupling portions;

wherein the accommodating portion comprises a connecting fabric, and the magnetic coupling portions comprise flexible magnetic strips sewn to one side of or inside within the connecting fabric;

wherein the accommodating portion forms a limiting cavity at a side of the magnetic coupling portions adjacent to the main body of the clothing, the limiting cavity comprising a space enclosed by the connecting fabric and side walls of the flexible magnetic strips, and wherein the limiting protrusion is received in the limiting cavity upon insertion; and wherein a cross-section of the insertion portion has an arrow shape, the limiting protrusion comprises a head of the arrow shape, and the limiting cavity is triangular in shape to match the head of the arrow shape, for wrapping around the limiting protrusion.

2. The detachable clothing assembly according to claim 1, wherein a limiting groove is recessed into mutually opposed surfaces of the magnetic coupling portions, and the limiting protrusion is snapped into the limiting groove to achieve limiting the position.

3. The detachable clothing assembly according to claim 1, wherein the flexible magnetic strip has a thickness of 0.5 mm-3 mm, a width of 15 mm-30 mm, and a length of 230 mm-500 mm.

4. The detachable clothing assembly according to claim 1, wherein reserved grooves are respectively formed on adjacent side surfaces of ends of the magnetic coupling portions that are away from the limiting cavity, and the two reserved grooves form a second gap when the magnetic coupling portions are attracted and fit together.

5. The detachable clothing assembly according to claim 1, wherein the mounting component further comprises a connector, one end of the connector is configured to be connected to the main body of the clothing, and the other end of the connector is connected to the accommodating portion.

6. The detachable clothing assembly according to any one of claim 1, wherein the mounting component is sewn or detachably connected to the main body of the clothing.

7. The detachable clothing assembly according to claim 1, wherein at least a portion of the main body of the accessory extends toward a side of the mounting component to cover the mounting component.

8. A garment, comprising:

a main body of the garment; and the detachable clothing assembly according to claim 1, wherein the mounting component of the detachable clothing assembly is sewn or detachably connected to the main body of the garment.

9. The garment according to claim 8, wherein the mounting component comprises an armhole, the accessory comprises a cuff, and the cuff is detachably connected to the armhole.

10. The garment according to claim 8, wherein the mounting component comprises a collar stand, the accessory comprises a hood, and the hood is detachably connected to the collar stand.

11. The garment according to claim 8, wherein the mounting component comprises a collar stand, the accessory comprises a neckerchief, and the neckerchief is detachably connected to the collar stand.

12. The garment according to claim 8, wherein the mounting component comprises a collar stand, the accessory comprises a collar face, and the collar face is detachably connected to the collar stand.

* * * * *